United States Patent [19]

Barry

[11] Patent Number: 4,640,278

[45] Date of Patent: Feb. 3, 1987

[54] EMERGENCY AIR ACCESS AND SIGNAL

[76] Inventor: John C. Barry, 1411 N. Fairfax #17, West Hollywood, Calif. 90046

[21] Appl. No.: 642,422

[22] Filed: Aug. 20, 1984

[51] Int. Cl.[4] ..... A62B 7/00

[52] U.S. Cl. ..... 128/206.12; 128/206.27

[58] Field of Search ..... 128/206.12, 200.24, 128/202.13, 206.27; 340/331, 332, 308

[56] References Cited

U.S. PATENT DOCUMENTS

| | | | |
|---|---|---|---|
| 835,075 | 11/1906 | Mahaffy | 128/202.13 |
| 3,913,092 | 10/1975 | Klingenberg | 340/331 |
| 4,331,139 | 5/1982 | Popa | 128/206.12 |
| 4,373,522 | 2/1983 | Zien | 128/200.24 |
| 4,467,796 | 8/1984 | Beagley | 128/200.24 |
| 4,518,946 | 5/1985 | Solomon | 340/331 |

*Primary Examiner*—William E. Kamm

[57] ABSTRACT

An emergency air access for a room with a window set in a casement. A semitransparent box is adhered to the window and has a breakaway rear wall. The box contains a breathing mask and an emergency flashing light with a switch actuated upon the rear wall's removal. A breathing tube connects the mask through a charcoal filter to a passageway in the window casement through which the tube passes outside. The passageway in the outside end of the tube contains a mesh filter to keep it free from debris.

7 Claims, 7 Drawing Figures

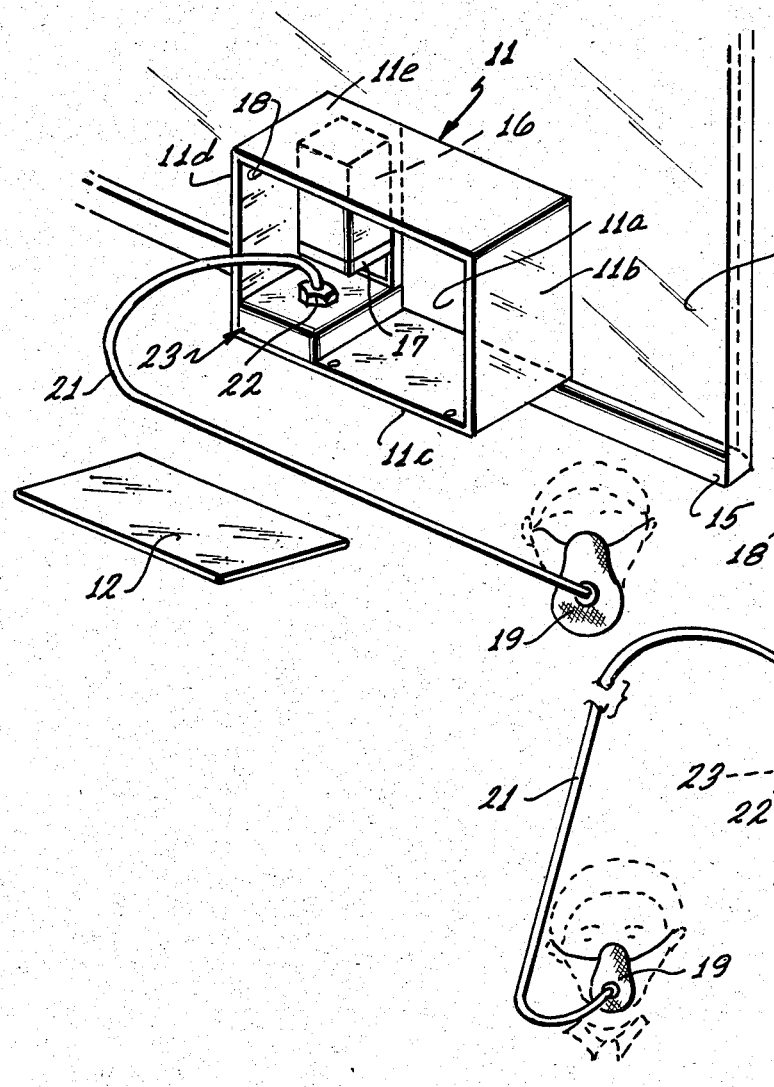
Fig. 1
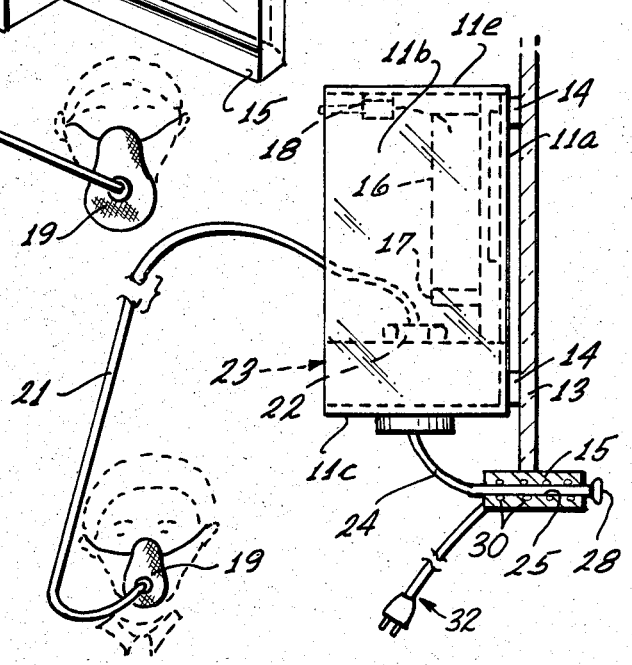
Fig. 3
Fig. 2
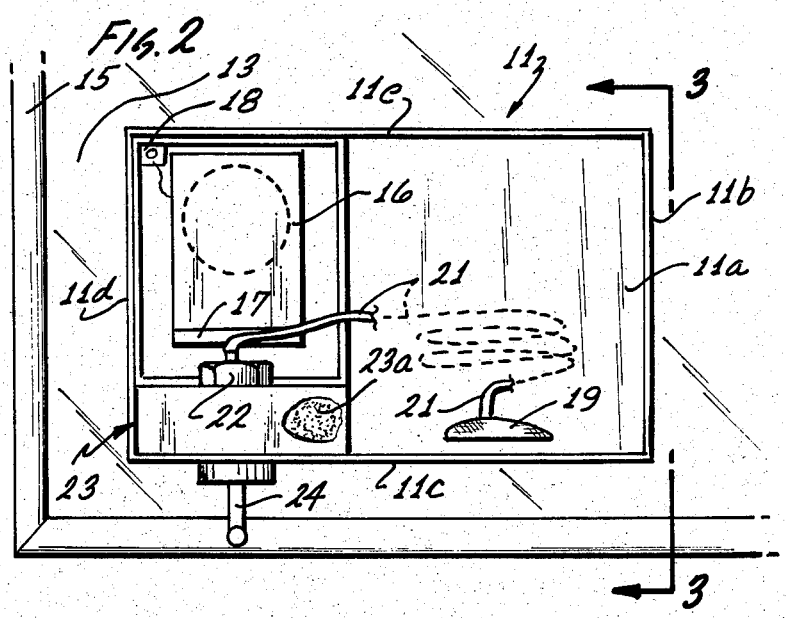

EMERGENCY AIR ACCESS AND SIGNAL

BACKGROUND OF THE INVENTION

This invention relates to an emergency air supply and signaling system for use by building tenants or guests in the event of fire so as to prevent smoke inhalation and also to signal for rescue. The invention was promoted by the loss of life in recent hotel fires due to guests being overcome by smoke and noxious fumes and an inability to concentrate the rescue effort effectively for lack of some signal as to the location of those trapped.

Heretofore, a device of this type for use by guests during fires has been known from U.S. Pat. No. 4,373,522 which describes a conduit unit adapted to be built through a building wall for admitting outside air. It uses a push rod operated trap door opening outward from the building wall. The trap door is an upwardly facing and outward extending, hinged door from the lower exterior of the unit. The U.S. Pat. No. 4,373,522 conduit unit is constructed with an inner chamber set into the wall and into which the air is drawn through a filter by breathing through a face mask connected to the chamber by a flexible tubing. While the concept disclosed in U.S. Pat. No. 4,373,522 points in the right direction in that it provides a trapped person access to outside air, it still suffers from many difficulties. It requires the entire body of the device to be installed through the structure of the wall in the manner of conduit, which, for reasons of feasibility, is mostly limited to new construction. Even so, such an installation is always a potential source for water leakage because of a significant passageway needed to mount the device breaches the integrity of the wall. Most existing office buildings and the like cannot be adapted to accomodate a hole so large as is required to accept such a device. The U.S. Pat. No. 4,373,522 device has a large upwardly facing outer door which is difficult to maintain, particularly in high rise buildings. Further, inadequate provision is made in U.S. Pat. No. 4,373,522 for signalling to show the need for rescue. U.S. Pat. No. 4,373,522 proposes a streamer signal but does not disclose how it is to be launched. Moreover, such a streamer will not be visible at night or through smoke. There is, therefore, a need for a new and improved device of the type disclosed.

OBJECTS AND SUMMARY OF THE INVENTION

A general object of the invention is to provide an emergency air supply and signal which will overcome the above limitations and disadvantages.

A further object is to provide an air supply and signaling system of the above character which employs a box adapted to be mounted on the inside surface of a window with the air supply feature being provided through a small hole in the adjacent window casement.

A further object of the invention is to provide an air supply and signaling system of the above character which provides a flashing light directed through the window to signal for rescue whenever the unit is placed in operation.

A further object of the invention is to provide a fresh air supply and signaling system of the above character which utilizes gas mask quality filters of standard specifications.

A further object of the invention is to provide a fresh air supply and signaling system of the above character which is designed with sufficient structural integrity as to be tamper proof and which, if tampered, will make such tampering immediately evident to hotel or building maintenance staff.

In general, the invention provides an emergency air supply and signal in the form of a red plastic box containing a strobe light and breathing masks and adhered to a building window. The box houses one or more masks connected to the outlet of a filter stage by an adapter. The inlet side of the filter is connected to outside air through a tube passed through a port in the window casement. In operation, the user taps the rear of the box, the rear cover falling away to release a light switch thereby connecting an associated battery to the strobe light. The user pulls out the mask and puts it on, breathing normally through the filter and tubing hoses. The user can check through the window for possible rescue. His location will be readily identified by the strobe light. Windows without a strobe may be disregarded by the rescue team.

Other features and objects of the invention will become apparent from the following description and claims, when taken with the accompanying drawings, of which:

BRIEF DESCRIPTION OF THE DRAWINGS

FIG. 1 is an isometric view of a window in a building fitted with an emergency air access and signal constructed in accordance with the invention then showing the back thereof falling away.

FIG. 2 is a rear elevational view of the emergency air access and signal of FIG. 1.

FIG. 3 is a cross-sectional view taken along the lines 3—3 of FIG. 2.

DETAILED DESCRIPTION OF THE PREFERRED EMBODIMENTS

Figure 4:
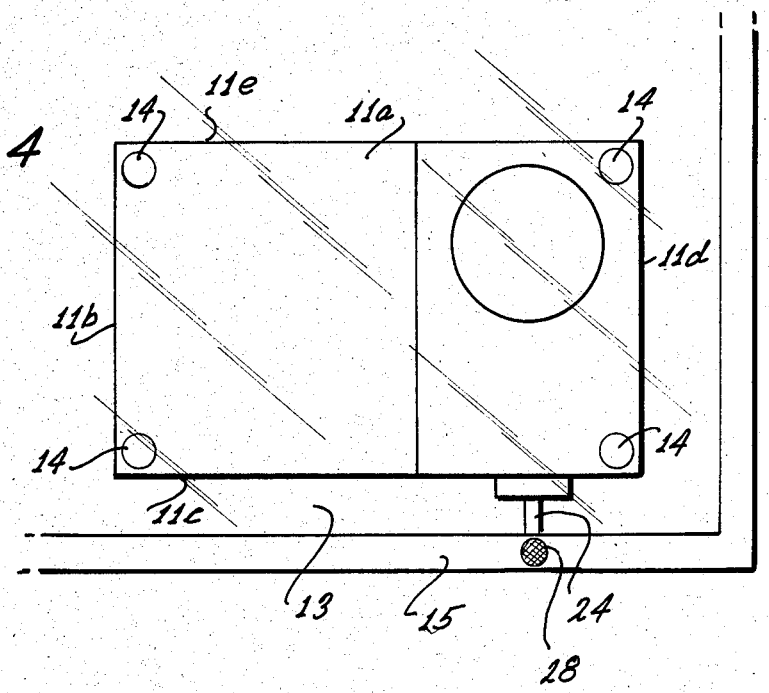
FIG. 4 is a front elevational view of the emergency air access and signal of FIG. 1 looking through the window to which it is mounted.

In general, the present invention employs a box 11 of five walls 11a-e to which a rear wall or cover 12 is removably fastened and adapted to fall way from the box of its own accord upon the box being given a smart tap from the rear. The front wall 11a of the box is attached to the windowpane 13 at any convenient location such as a lower corner and is secured thereto by a double-faced adhesive pads 14. The windowpane is mounted in casement 15 in a conventional way.

The box may be made of any suitable material but is preferrably a clear colored plastic, as for example red, to indicate emergency use. The front wall 11a is clear or transparent while the other walls may be clear, translucent, or opaque in this respect.

A flashing light 16 incorporating a strobe and a battery 17 is mounted in the box so that the light shines through the front wall 11b and through the windowpane 13. The strobe light is capable of intermittent flashing operation from the included storage battery for up to about four hours. The light is connected to the battery through an on-switch which 18 is preferrably located with its actuating element pressing against the rear wall 12 so as to be activated upon removal of the rear wall.

Breathing means is provided in the form of a ventilated nose mask 19 arranged to rest inside the box and to be removed by hand when the same is opened. The mask 19 is of the type where an inhalation closes a one way valve relief ports so that draw is established while exhalation opens the ports. A hose or tube 21 connects the mask to an inlet adapter 22 on a filter stage 23 containing a charcoal filter 23*a* and preferably an intake check valve allowing draw from the mask to pull air through the filter but blocking exhalation. The inlet side of the filter is connected through an airway hose or tube 24 run through a hole 25 formed in the window casement and leading to the outside of the building to which it is sealed with suitable plasticized or elastomeric sealant.

The filter 23 includes a filter holder wih the filter element 23*a* sealed as a self-contained unit, not removable. In order to replace the filter, it is necessary to replace the entire filter stage. By this contruction, tampering and theft of filter elements is avoided. The element itself is preferably MSA grade chemical cartridge filter such as GMC 464046 meeting the Mine Safety and Health Administration specification #TC-23C-47.

The mask tube 21 and airway tube 24 are flexible and of common non-collapsible construction of heavy walled elastomeric material such as rubber, neoprene and the like. The end of the airway tube 24 projects somewhat to the outside of the building wall and is preferably fitted with a plastic mesh filter 28 to prevent insect or debris from being lodged or sucked into its airway.

The light 16 is an Eclipse Night Rider or equivalent fitted with a Polaroid P-100 battery and will flash for about four hours with a visibility up to one mile. The light is preferably amber in color.

As will be observed, the present invention has no air chambers, no wall chambers, no user operated moving parts or moving walls and, no push rods or other necessary metal parts effecting its operation. No metal corrosion of such parts can occur. The construction of the present invention provides an airway path leading directly to the outside, has no storage oxygen, does not require any exterior baffle plates, cannot be tampered with and contains a reliable emergency light signal which is automatically actuated when the box is opened. It is positioned where visual access by the user to look outside for help is also available. This feature provides considerable psychological boost to the user. The maintenance schedule requires the battery to be replaced every 12 months and the sealed air filter every 24 months.

The user operating instructions are as follows, but are nearly self-evident.

OPERATING INSTRUCTIONS

1. Break seal and remove back panel.
2. Remove Air Mask.
3. Place Air Mask over nose and mouth and hold in position by placing elastic around the back of head.
4. Breathe freely.
5. A flashing light has been automatically activated which will alert the Fire Dept. of your presence.

A card may be laid in the box to advise the user of procedure in an emergency as follows:

In the event of a fire, keep all doors and windows CLOSED.

DON'T PANIC—Remain calm at all times. (The Fire Dept. having been alerted of your presence, will rescue you in sequence of priority).

DON'T move away from the window, as you may disconnect the Air Mask from the 'RED BOX' and it will cease to function.

DON'T break the glass, as this may increase the density of the fire—placing your life in further danger.

DON'T remove the Air Mask from your face until you have been assured it is safe to do so by the Fire Dept., as SMOKE and TOXIC FUMES may still be present in the building, even after the fire has been extinguished.

Follow this advice carefully and the Fire Dept. will have a better chance of rescuing you safely.

The operation of the device of this invention in an emergency is as follows:

The back panel 12 is hit or smacked by the person in distress—and this panel, which is fitted with a 'crash' release mechanism, immediately detaches itself from the casing of the box 10.

Immediately the lamp is activated to warn fire personnel or other rescuers that there is a person where box is sited, in distress, and in the part of the building, where the lamp is 'Flashing'. The fire personnel/rescuers outside the building can easily locate and identify the room, where the person is trapped inside by the location of the flashing light.

The person in distress would then remove a red card with white reflective lettering with the word 'HELP' printed thereon—from the box and hang this card on the outside doorknob of the room. The purpose of the card is to enable fire personnel/rescuers to immediately locate a person trapped in any rooms, while making a search of the interior of the building. The card would save fire personnel/rescuers valuable time in hacking down interior doors of unoccupied rooms. With the electricity supply turned off, the reflective material on the card would immediately give attention of a distressed person to fire personnel/rescuers, while searching the building with their lamps.

The person in distress, after placing the HELP card on the outside doorknob of his room, would close the door leaving it unlocked and return to the Red Box.

He would then remove the air mask from the storage compartment and place the air mask over his nose and mouth and would then breathe fresh air (free from the toxic fumes inside the building) by drawing air from the outside of the building.

The person then remains calm until rescued.

Fresh air, from the outside of the building, is sucked by the user into the air tube inlet. The air tube can be fitted within an electrical resistance wire or element so as to prevent snow or ice from covering up the air tube inlet. The wire or element is powered by being connected to a source of electrical current through conventional means.

The fresh air then passes through the air tube through the air tube connector union and into the filter where it is cleaned of any impurities and passes through the filter/air mask adaptor and continues along air tube to the Air Mask and into the lungs of the user sucking the air through the apparatus—exhaling through the 'breather' nozzle, or exhalation relief valve fitted to the air mask.

Figure 5:
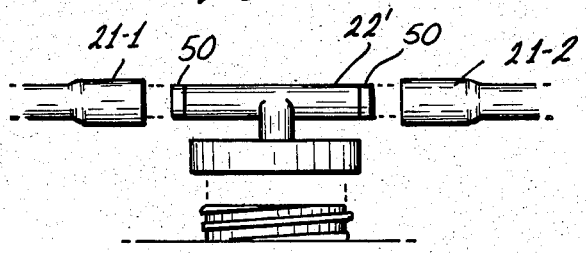
FIG. 5 is an exploded view of a modified air access according to FIG. 1 employing an adaptor for use in connecting two masks within the same device.
Figure 6:
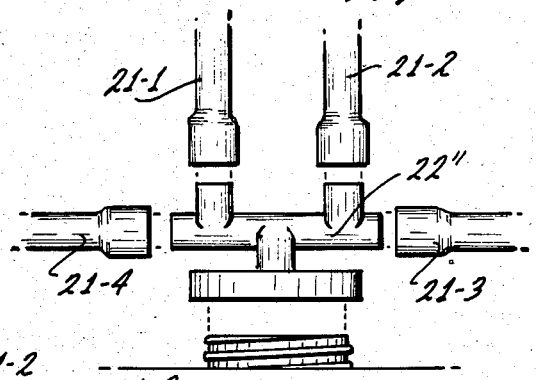
FIG. 6 is an exploded view of a modified air access constructed in accordance with the present invention and employing an adaptor for use in connecting four masks.
Figure 7:
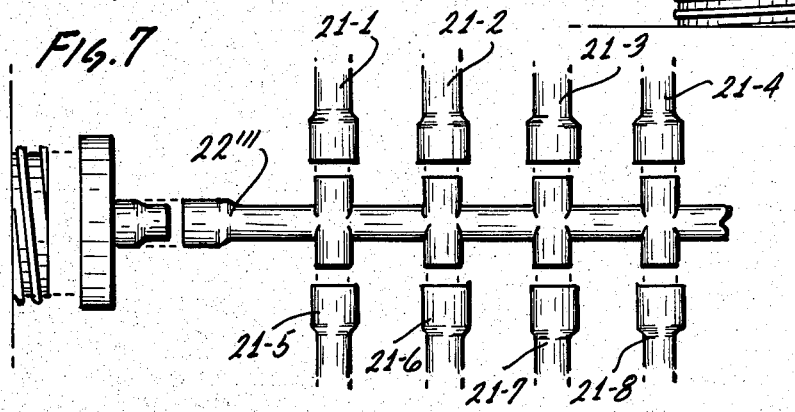
FIG. 7 shows an adaptor similar to those disclosed in FIG. 5 and 6 and constructed for connecting eight or more masks.

FIG. 5 shows an alternate adapter 22' for connecting 21-1 and 22-1 to two masks. FIGS. 6 and 7 show adapters 22" and 22" for connecting four and multiple masks. Such adapters will contain one way valves 50 to pass air only in the direction of the attached user hose so as to prevent cross breathing.

What is claimed is:

1. An emergency fresh air access for use in a room having a window facing to the environment outside of the building and set in a casement, comprising: means forming a passage in said casement or window, means forming a housing, said housing having walls one of which is transparent, another of said walls being removable from the housing to thereby leave that portion of the housing covered by said wall open to provide an access, means for securing the transparent wall of the housing to the window, a breathing mask, said housing providing space for storing said mask, said mask being accessible through said access, a filter stage having an inlet and an outlet, said filter stage being carried in said housing, a first tube, said passage being just large enough to allow said first tube to pass therethrough, means for connecting one end of said first tube through the passage to the outside environment, connector means for connecting the other end of said first tube to the inlet of said filter stage, a second tube, means connecting one end of the second tube to the mask and the other end to the outlet of the filter stage so that said first tube, filter, second tube, and mask are connected in series to define an airflow path therethrough between the outside environment and the mask, a signal light mounted in the housing to shine through the window to which it is mounted, a power source for said signal light, switch means for connecting said light to said power source, said switch means mounted in proximity to said one wall to respond when the one wall is removed to switch on the light.

2. The emergency air access as in claim 1 in which said means for securing the housing to the window comprising a plurality of double-sided adhesive pads interposed and stuck between the housing front wall and the window.

3. The emergency air access as in claim 1 wherein said housing is made of a clear plastic and formed with integral front, side, top, rear, and bottom walls.

4. An emergency air access as in claim 1 wherein said signaling light is of the strobe type to minimize current drain and further including a battery for operating said strobe light.

5. The emergency air access as in claim 1 in which said filter assembly includes a replaceable filter stage containing a MSA standard filer element.

6. The emergency air access as in claim 1 further including multiple outlet airway adapter connected to the outlet of said filter and a multiple set of masks connected thereto, each of said separate airways having an inline check valve.

7. The emergency air access as in claim 1 further including an electric resistance element associated with said inlet tube to prevent snow or ice from covering the inlet, and means for connecting the element to a source of electric power.

* * * * *